US006008788A

United States Patent [19]

Ishimaru

[11] Patent Number: 6,008,788

[45] Date of Patent: Dec. 28, 1999

[54] SEMICONDUCTOR DEVICE

[75] Inventor: Yoshiyuki Ishimaru, Itami, Japan

[73] Assignee: Mitsubishi Denki Kabushiki Kaisha, Tokyo, Japan

[21] Appl. No.: 07/956,497

[22] PCT Filed: May 8, 1992

[86] PCT No.: PCT/JP92/00588

§ 371 Date: Jan. 6, 1993

§ 102(e) Date: Jan. 6, 1993

[30] Foreign Application Priority Data

May 9, 1991 [JP] Japan ..... 3-104214

[51] Int. Cl.[6] ..... G09G 3/36

[52] U.S. Cl. ..... 345/98; 345/204; 349/149

[58] Field of Search ..... 345/205, 206, 345/204, 87, 98, 100, 103; 349/149, 152

[56] References Cited

U.S. PATENT DOCUMENTS

| | | | |
|---|---|---|---|
| 4,613,855 | 9/1986 | Person et al. | 345/206 |
| 4,684,974 | 8/1987 | Matsunaga et al. | 345/205 |
| 4,985,663 | 1/1991 | Nakatani | 345/205 |
| 5,260,698 | 11/1993 | Munetsugu et al. | 345/205 |

FOREIGN PATENT DOCUMENTS

| | | | |
|---|---|---|---|
| 62-128551 | 6/1987 | Japan . | |
| 63-70450 | 3/1988 | Japan . | |
| 63-276029 | 11/1988 | Japan . | |
| 1241597 | 9/1989 | Japan | 345/206 |
| 1267688 | 10/1989 | Japan | 345/205 |
| 2043596 | 2/1990 | Japan | 345/205 |
| 2131281 | 5/1990 | Japan | 345/205 |
| 2296284 | 12/1990 | Japan | 345/205 |
| 2145561 | 3/1985 | United Kingdom | 345/205 |

*Primary Examiner*—Steven J. Saras
*Attorney, Agent, or Firm*—Leydig, Voit & Mayer, Ltd.

[57] ABSTRACT

To obtain a semiconductor device with reduced substrate cost and facilitated substrate design, there are provided, in a semiconductor chip, a segment driver for outputting segment signals for a display device and a common driver for outputting scanning signals for the display device, and a group of segment terminals continuously arranged on opposite sides of the semiconductor chip at predetermined intervals. Further, common terminals are arranged adjacent to the segment terminals in two groups, one group including common terminals electrically connected to the common driver and another group including the other common terminals.

3 Claims, 10 Drawing Sheets

SEMICONDUCTOR DEVICE

FIELD OF THE INVENTION

This invention relates to a semiconductor device and, in particular, to a semiconductor device for controlling and driving display devices.

DESCRIPTION OF THE RELATED ART

Nowadays, liquid crystal display panels (hereinafter referred to as "LCD panels") are being used in the display sections of OA apparatus, such as facsimile apparatus and copying machines, and AV apparatus, such as audio apparatuses and VTR, and various types of LSI for controlling and driving such LCD panels have been developed.

FIG. 9 is a plan view showing a conventional microcomputer having a built-in controller and drivers for controlling and driving a LCD panel. In the drawing, numeral 1 indicates a CPU for data operation and for controlling the entire system; numeral 2 indicates a ROM for storing commands from the CPU 1; numeral 3 indicates a RAM for storing data for the operations conducted by the CPU 1; numeral 4 indicates a timing signal generation circuit for generating signals for effecting timing control of various operations on the basis of clock signals; numeral 5 indicates a LCD controller for controlling a LCD panel 15 (see FIG. 10); numeral 6 indicates a common driver for outputting signals for driving scanning electrodes (COM 0 through 15) of the LCD panel 15 upon receiving signals from the LCD controller 5; numeral 7 indicates a LCD display RAM for supplying display data set by the CPU 1 to a segment driver 8; numeral 8 indicates the segment driver for outputting signals for driving signal electrodes (SEG 0 through 79) (see FIG. 10) of the LCD panel 15 upon receiving the output of the LCD display RAM 7; and numeral 9 indicates a semiconductor chip realized by forming these components, indicated by numerals 1 through 8, on the same semiconductor substrate. Numeral 10 indicates common terminals COM 0 through 15 which are opposed to a side of the semiconductor chip 9 and arranged continuously along this side at intervals, for example, of 0.50 mm and which are used to extract the signals output from the common driver 6; numeral 11 indicates segment terminals SEG 0 through 79 which are opposed to sides of the semiconductor chip 9 and arranged continuously along these sides at intervals, for example, of 0.50 mm and which are used to extract the signals output from the segment driver 8; and numeral 12 indicates external terminals which are opposed to sides of the semiconductor chip 9 and continuously arranged along these sides, adjacent to the common terminals 10 and segment terminals 11, at intervals, for example, of 0.50 mm and which are used to input and output signals which are other than those output from the common driver 6 and the segment driver 8 and which are necessary for the operation of the semiconductor chip 9. Numeral 13 indicates a flat package (semiconductor device) sealing the semiconductor chip 9 in such a way that the terminals 10 to 12 are exposed on the outside.

FIG. 10 is a plan view showing a multi-layer printed circuit board packaging a LCD panel having scanning electrodes (COM 0 through 15) on a pair of opposed sides thereof and a conventional microcomputer as shown in FIG. 9. In the drawing, numeral 14 indicates the multi-layer printed circuit board; numeral 15 indicates a LCD panel mounted on the multi-layer printed circuit board 14; numeral 17 indicates signal electrodes (SEG 0 through 79) of the LCD panel 15 which receive signals from the segment driver 8; numeral 16 indicates scanning electrodes (COM 0 through 15) of the LCD panel 15 which receive signals from the common driver 6; numeral 18 indicates a printed wiring group on the first layer of the multi-layer printed circuit board 14 and connecting COM 0 through COM 7 of the common terminals 10 to COM 0 through COM 7 of the scanning electrodes 16; and numeral 19 indicates a printed wiring group on the first and second layers of the multi-layer printed circuit board 14 and connecting COM 8 through COM 15 of the common terminals 10 to COM 8 through COM 15 of the scanning electrodes 16. In the drawing, the broken lines indicate the section of the printed wiring group formed on the second layer. Numeral 20 indicates a printed wiring group on the first layer of the multi-layer printed circuit board 14 and connecting SEG 0 through SEG 79 of the segment terminals 11 to SEG 0 through SEG 79 of the signal electrodes 17.

In the connection shown in FIG. 10, that section of the printed wiring group 19 which is on the second layer and the printed wiring group 20 cross each other, so that connection in one plane is impossible, thus necessitating connection by multi-layer wiring using a multi-layer printed circuit board. However, use of a multi-layer printed circuit board leads to high substrate cost. Further, connection by multi-layer wiring complicates the substrate design.

SUMMARY OF THE INVENTION

This invention has been made with a view toward solving the above problems. It is an object of this invention to provide a semiconductor device which contributes to a reduction in substrate cost and facilitates substrate design.

A semiconductor device according to this invention comprises: a semiconductor chip including segment signal outputting means having a plurality of output nodes for outputting segment signals for a display device controlled and selected by segment signals and scanning signals, and scanning signal outputting means having a plurality of output nodes for outputting scanning signals for the display device; a first outlet-terminal group including of a plurality of segment-signal outlet terminals arranged continuously at first and second, opposite sides of the semiconductor chip at predetermined intervals and respectively electrically connected to corresponding output nodes of the segment signal outputting means; a second outlet-terminal group including a plurality of scanning-signal outlet terminals opposed to the first side of the semiconductor chip and arranged adjacent to the segment-signal outlet terminal at one the first side of the semiconductor chip at predetermined intervals and respectively electrically connected to corresponding output nodes of the scanning signal outputting means; and a third outlet-terminal group including a plurality of scanning-signal outlet terminals opposed to the second side of the semiconductor chip and arranged adjacent to the segment-signal outlet terminal at the second side of the semiconductor chip at predetermined intervals and respectively electrically connected to corresponding output nodes of the scanning signal outputting means.

A semiconductor device according to a second embodiment of this invention comprises: a semiconductor chip including segment signal outputting means having a plurality of output nodes for outputting segment signals for a display device controlled and selected by segment signals and scanning signals, and scanning signal outputting means having a plurality of output nodes for outputting scanning signals for the display device; a first outlet-terminal group including a plurality of segment-signal outlet terminals arranged continuously at first and second, opposite sides of the semiconductor chip at predetermined intervals and respectively electrically connected to corresponding output nodes of the segment signal outputting means; a second outlet-terminal group including a plurality of scanning-signal outlet terminals opposed to the first side of the semiconductor chip and arranged adjacent to the segment-signal outlet terminals at the first side of the semiconductor chip at predetermined intervals; a third outlet-terminal group including a plurality of scanning-signal outlet terminals opposed to the second side of the semiconductor chip and arranged adjacent to the segment-signal outlet terminal at the second side of the semiconductor chip at predetermined intervals; and selection means on the semiconductor chip for selectively outputting scanning signals from the scanning signal outputting means to the plurality of scanning-signal outlet terminals of one of the second and third outlet-terminal groups.

A semiconductor device according to a third embodiment of this invention comprises: a semiconductor chip including segment signal outputting means having a plurality of output nodes for outputting segment signals for a display device controlled and selected by segment signals and scanning signals, and scanning signal outputting means having a plurality of output nodes for outputting scanning signals for the display device; a first outlet-terminal group including a plurality of segment-signal outlet terminals arranged continuosly at first and second, opposite sides of the semiconductor chip at predetermined intervals and respectively electrically connected to corresponding output nodes of the segment signal outputting means; a second outlet-terminal group including a plurality of scanning-signal outlet terminals opposed to the first side of the semiconductor chip and arranged adjacent to the segment-signal outlet terminal at the first side of the semiconductor chip at predetermined intervals and respectively electrically connected to corresponding output nodes of the scanning signal outputting means; a third outlet-terminal group including of a plurality of scanning-signal outlet terminals opposed to the second side of the semiconductor chip and arranged adjacent to the segment-signal outlet terminal at the second side of the semiconductor chip at predetermined intervals and respectively electrically connected to corresponding output nodes of the scanning signal outputting means; and a fourth outlet-terminal group opposed to the first side of the semiconductor chip, arranged adjacent to the second outlet-terminal group and having at least one outlet terminal for electrical connection to the scanning-signal outlet terminals of the third outlet-terminal group.

In a semiconductor device constructed as described above, the second and third outlet-terminal groups are independent of each other through the intermediation of the first outlet-terminal group.

Also, in a semiconductor device constructed as described above, one of the second and third outlet-terminal groups is selected as needed.

Further, in a semiconductor device constructed as described above, the third and fourth outlet-terminal groups are connected together through the intermediation of a printed circuit board opposed to the reverse side of the semiconductor device.

BRIEF DESCRIPTION OF THE DRAWINGS

The present invention will be clearly understood from the following description of embodiments with reference to the accompanying drawings.

EMBODIMENTS

First Embodiment

Figure 1:
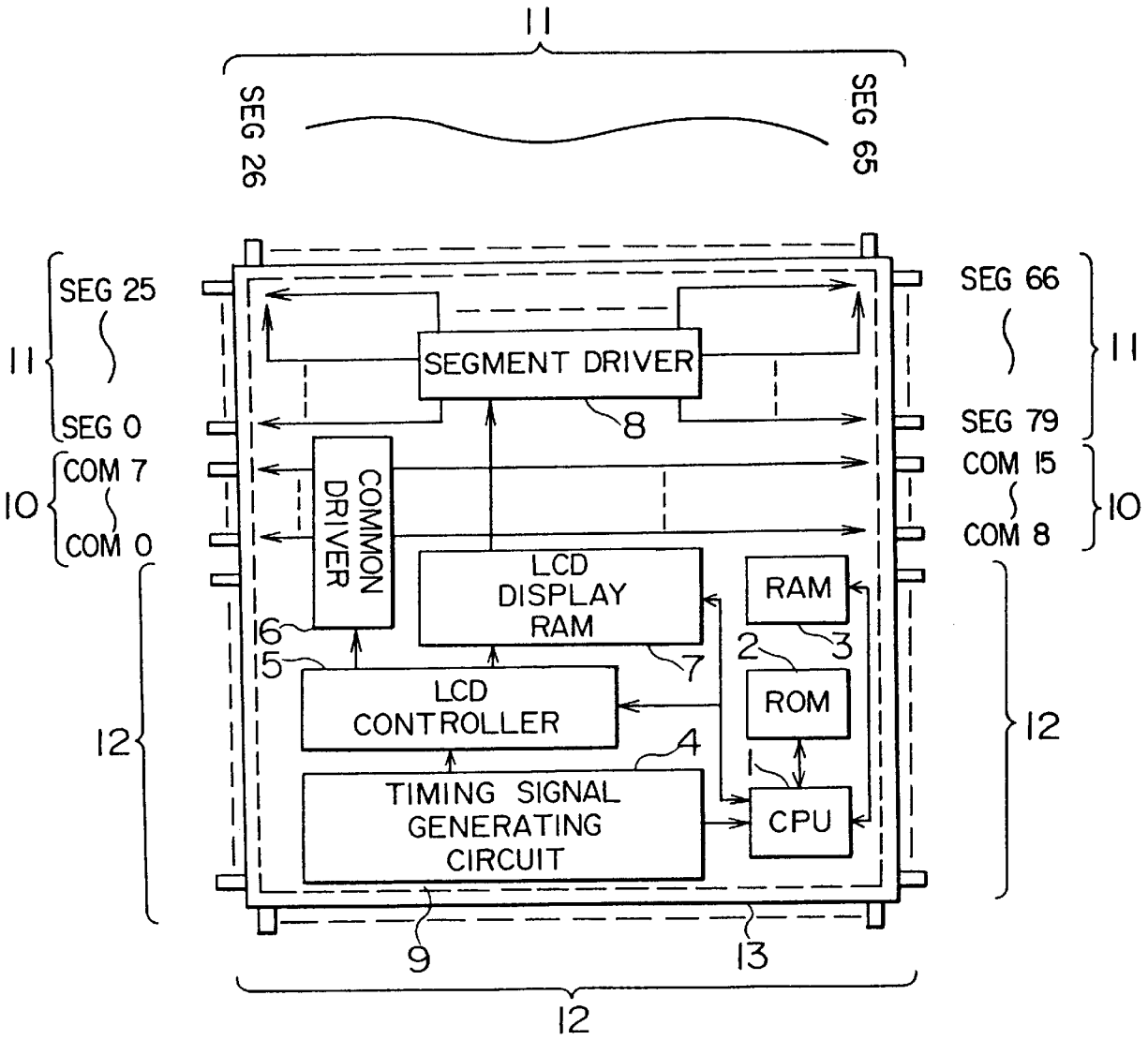
FIG. 1 is a plan view showing a first embodiment of this invention.

FIG. 1 is a plan view showing a semiconductor device according to an embodiment of this invention. In the following description of this invention, the components in the drawings which are the same as or correspond to those of the conventional device are indicated by the same reference numerals, and an explanation thereof is omitted. Referring to FIG. 1, the common terminals 10 are divided into two sections: first section (terminals COM 0 to 7) opposed to first side of the semiconductor chip 9 and arranged adjacent to the terminal SEG 0 at one end of the segment terminals SEG 0 to 25, continuously along the first side at intervals, for example, of 0.50 mm, and a second section (terminals COM 8 to 15) opposed to a second side of the semiconductor chip 9 and arranged adjacent to the terminal SEG 79 at one end of the segment terminals SEG 66 to 79, continuously along the second side at intervals, for example, of 0.50 mm.

The segment driver 8, which generates scanning signals for the display device through the control of the CPU 1, the LCD controller 5 and the LCD display RAM 7, is part of segment signal outputting means. The common driver 6, which generates scanning signals for the display device through the control of the CPU 1 and the LCD controller 5, is part of a scanning signal outputting means. The segment terminals SEG 0 to 79 are a first outlet-terminal group, the common terminals COM 0 to 7 are a second outlet-terminal group, and the common terminals COM 8 to 15 are a third outlet-terminal group.

Figure 2:
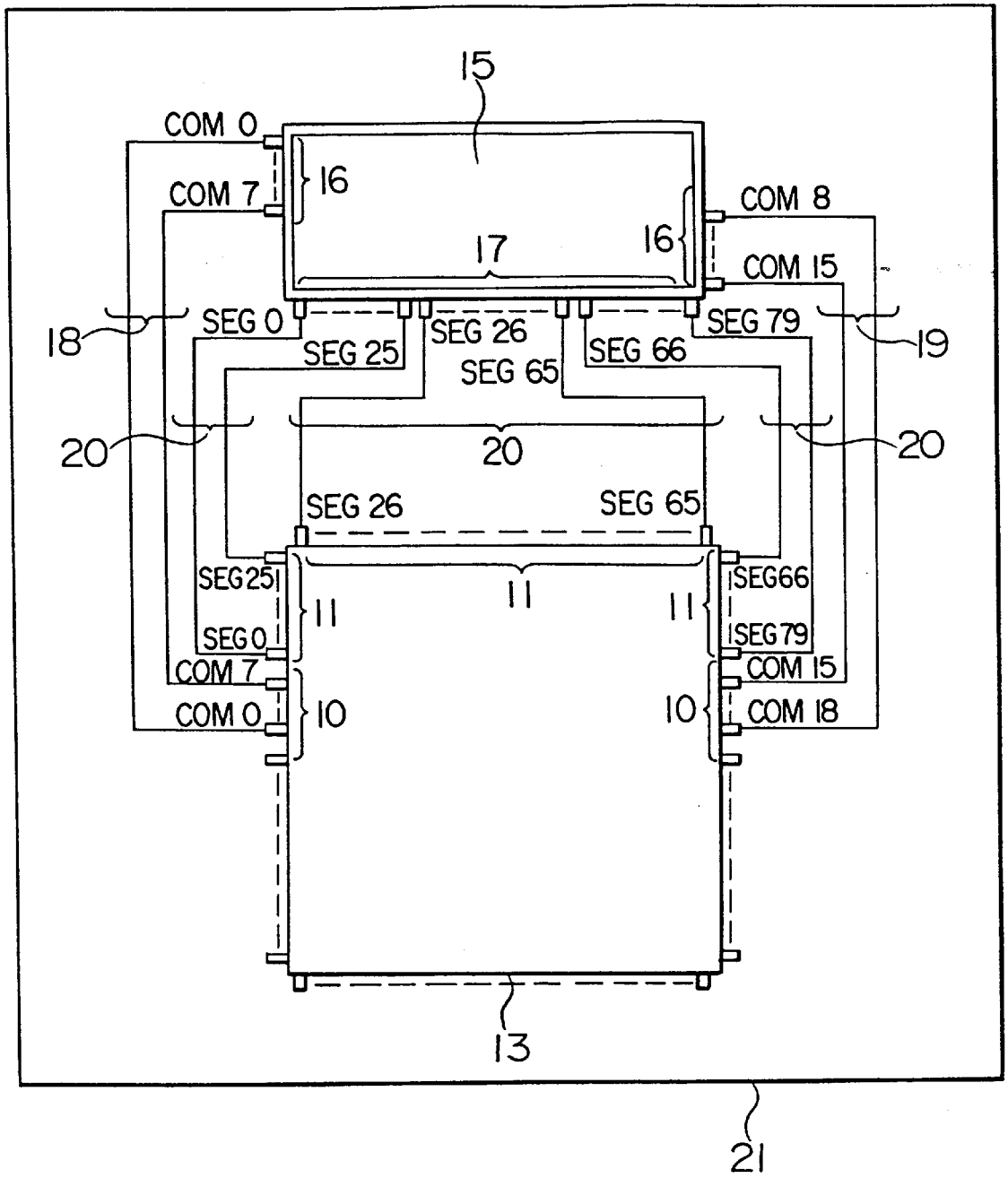
FIG. 2 is a plan view showing a substrate on which the first embodiment of the present invention and a LCD panel are mounted.

FIG. 2 is a plan view showing a single-layer printed circuit board on which are mounted a LCD panel 15, i.e., formed as a display device, having scanning electrodes COM 0 to 7 and COM 8 to 15 respectively disposed on opposed sides thereof and a microcomputer (semiconductor device) as shown in FIG. 1. In the drawing, numeral 21 indicates the single-layer printed circuit board. Printed wiring groups 18, 19 and 20 are on the surface of the single-layer printed circuit board 21.

In the connection shown in FIG. 2, however, the printed wiring groups 18, 19 and 20 do not cross each other, so that connection in one plane is possible, thus allowing connection using a single-layer printed circuit board 21. Thus, it is possible to produce a semiconductor device at low substrate cost and with facilitated substrate design.

Second Embodiment

Figure 3:
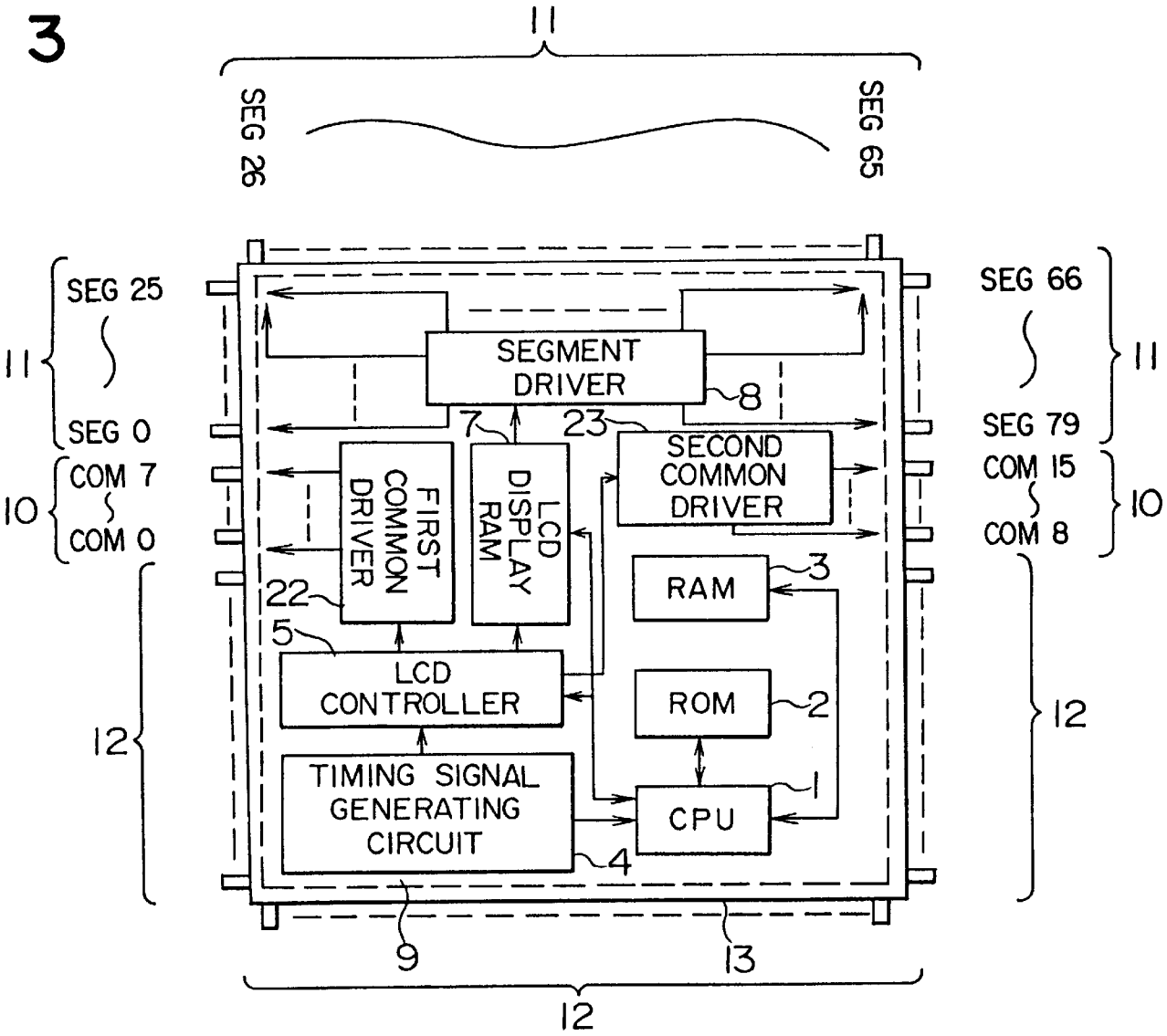
FIG. 3 is plan view showing a second embodiment of this invention.

FIG. 3 is a plan view showing a semiconductor device according to the second embodiment of this invention. In the drawing, numeral 22 indicates a first common driver on the semiconductor chip 9 and which outputs signals for driving the scanning electrodes 16 of the LCD panel 17 (see FIGS. 4 and 5) upon receiving signals from the LCD controller 5. Numeral 23 indicates a second common driver which is formed on the semiconductor chip 9 together with the first common driver 22 and which outputs signals for driving the scanning electrodes 16 of the LCD panel 15 upon receiving signals from the LCD controller 5. The CPU 1 and the LCD controller 5 are part of constitute a means for selecting one of the first and second common drivers 22 and 23.

Figure 4:
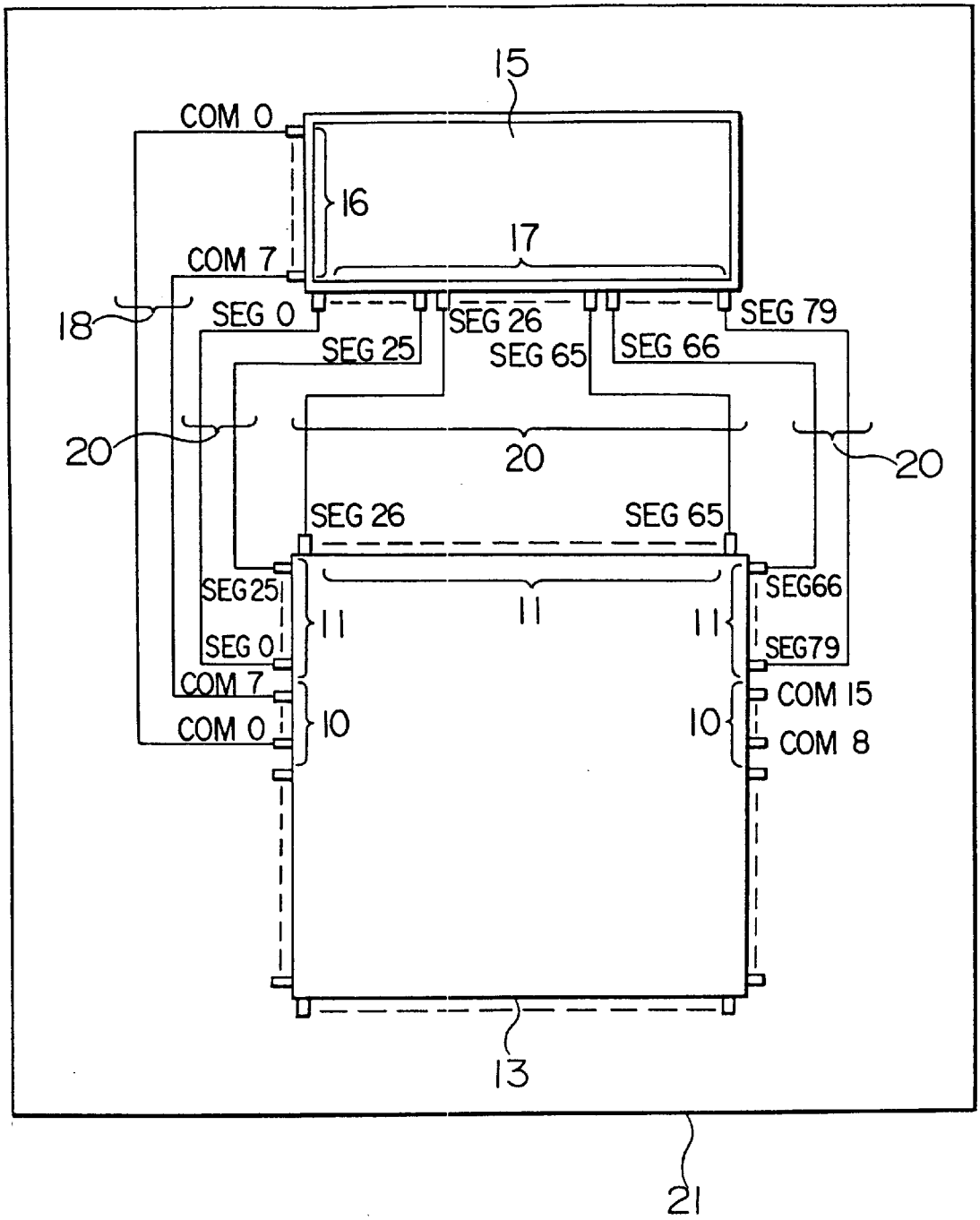
FIG. 4 is a plan view showing a substrate on which a device according to the second embodiment of this invention and a LCD panel are mounted.
Figure 5:
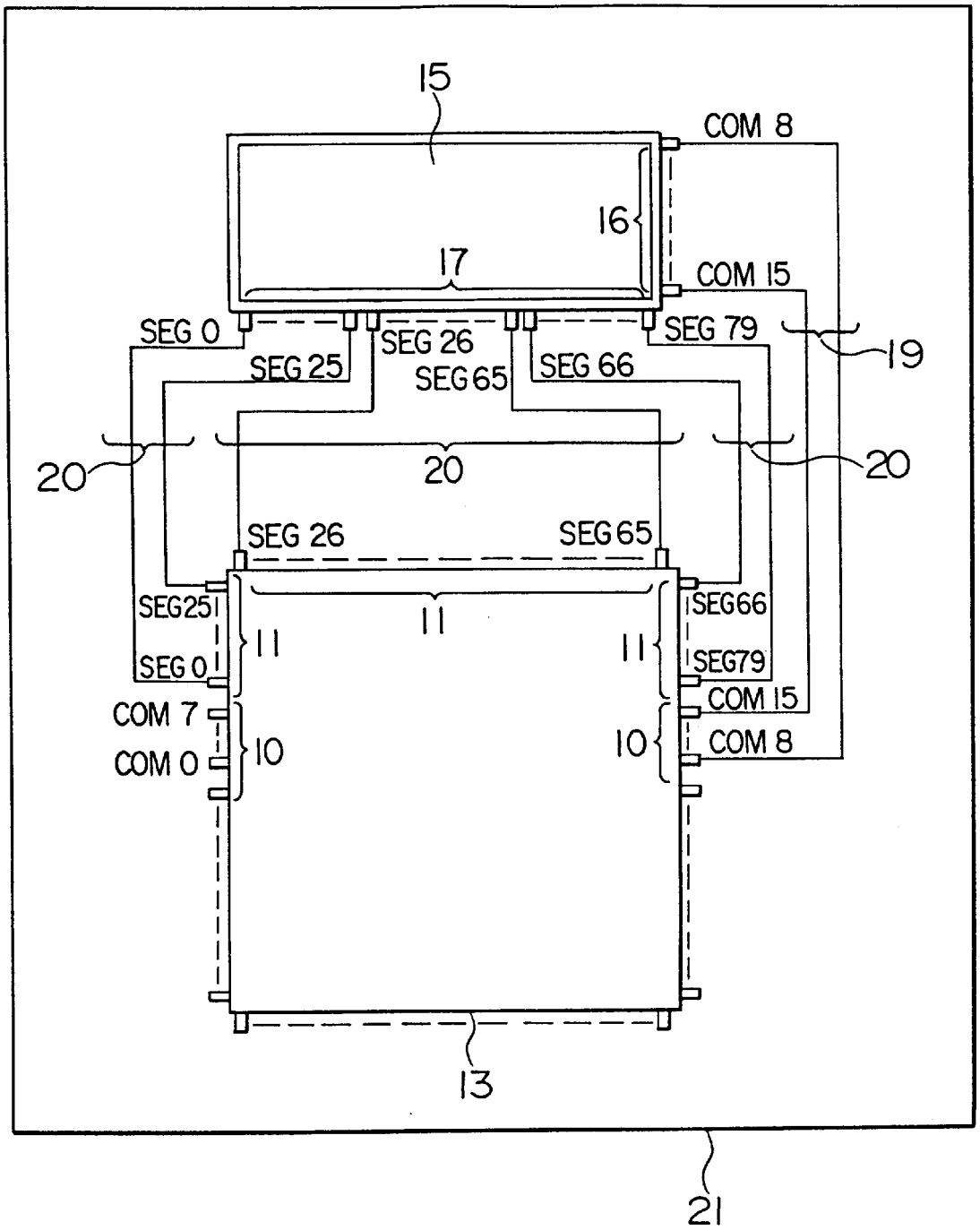
FIG. 5 is a plan view showing a substrate on which a device according to the second embodiment of this invention and a LCD panel are mounted.

FIGS. 4 and 5 are plan views showing a single-layer printed circuit board 21 on which are mounted a LCD panel 15 having scanning electrodes 16 on a first side thereof and a microcomputer (semiconductor device) as shown in FIG. 3. In FIGS. 4 and 5, the printed wiring groups 18, 19 and 20 are on the surface of the single-layer printed circuit board 21. In the case of the embodiment shown in FIG. 4, the LCD controller 5, upon receiving a command from the CPU 1, selects the first common driver 22, which outputs signals for driving COM 0 to COM 7 of the scanning electrodes 16 to COM 0 to COM 7 of the common terminals 10. In the case of the embodiment shown in FIG. 5, the LCD controller 5, upon receiving a command from the CPU 1, selects the second common driver 23, which outputs signals for driving COM 8 to COM 15 of the scanning electrodes 16 to COM 8 to COM 15 of the common terminals 10.

Thus, in accordance with the position of the scanning electrodes provided on the LCD panel 15, one of the two groups: COM 0 to COM 7 and COM 8 to COM 15, can be selected. However, in the connection shown in FIGS. 4 and 5, the printed wiring groups 18, 19 and 20 do not cross each other even with an LCD panel having scanning electrodes on only one side, so that connection in one plane is possible, thus allowing connection using a single-layer layer printed circuit board 21. Therefore, it is possible to obtain the same effect as that of the above embodiment.

Third Embodiment

Figure 6:
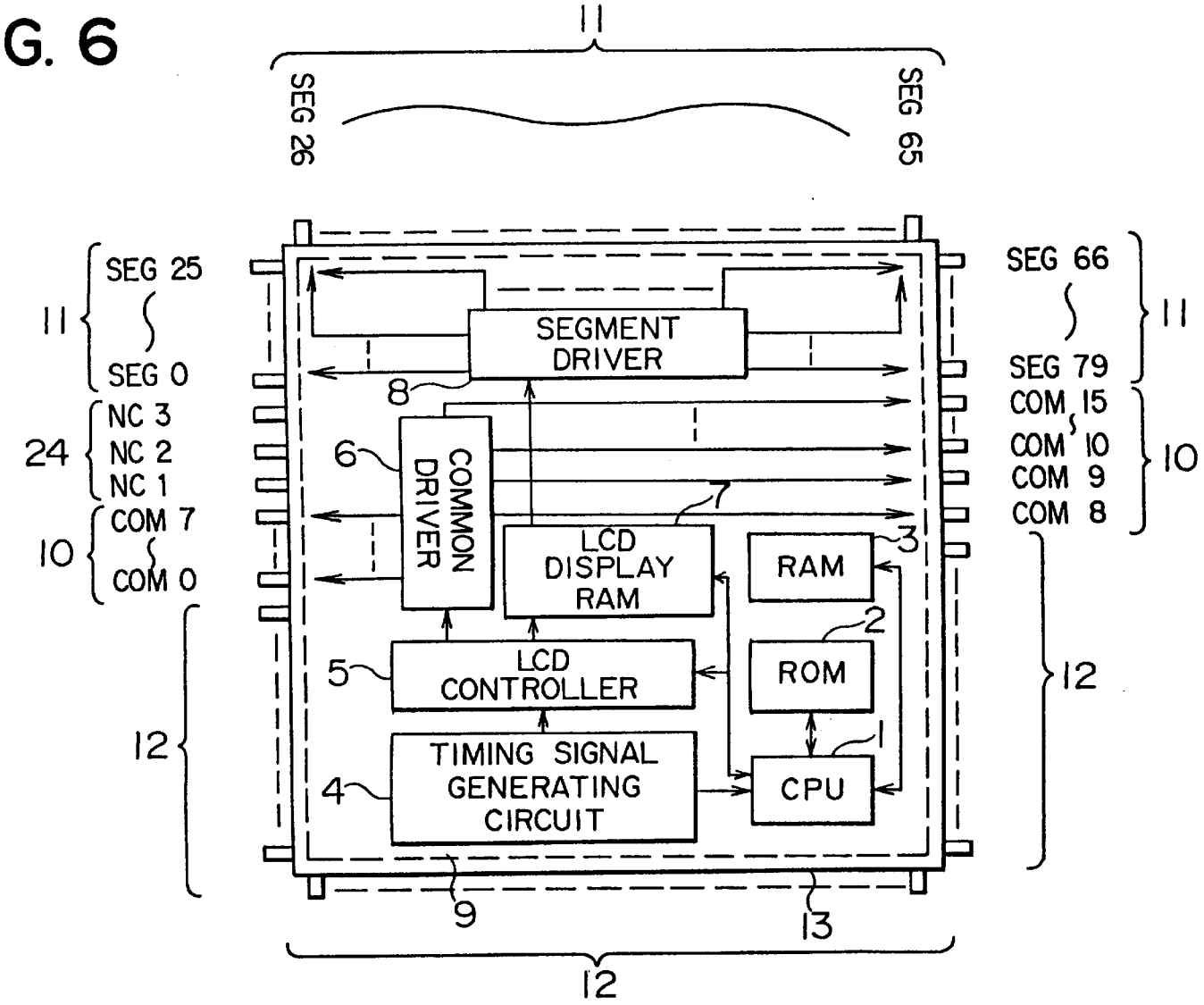
FIG. 6 is plan view showing a third embodiment of this invention.
Figure 7:
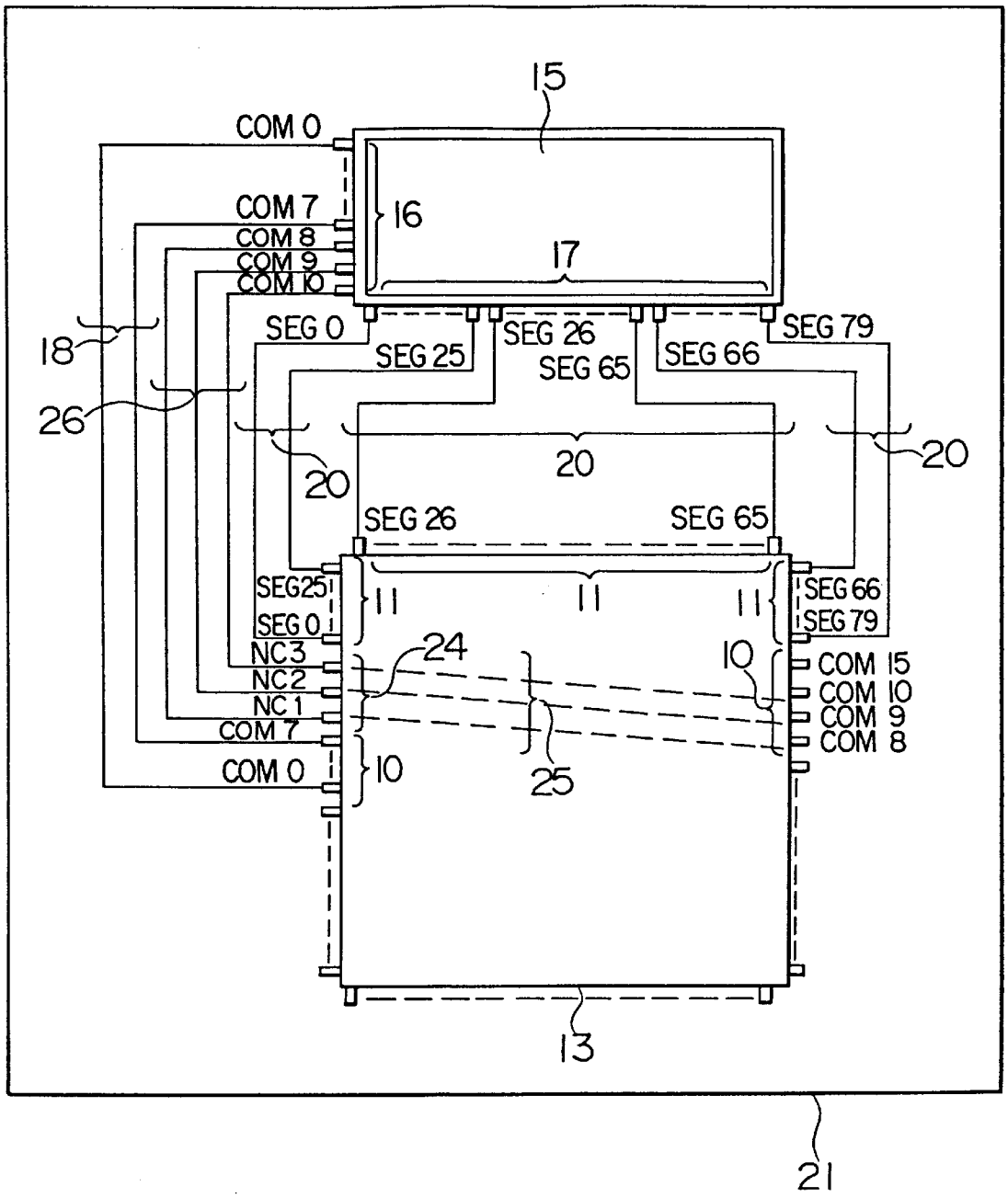
FIG. 7 is a plan view showing a substrate on which a device according to the third embodiment of this invention and a LCD panel are mounted.
Figure 8:
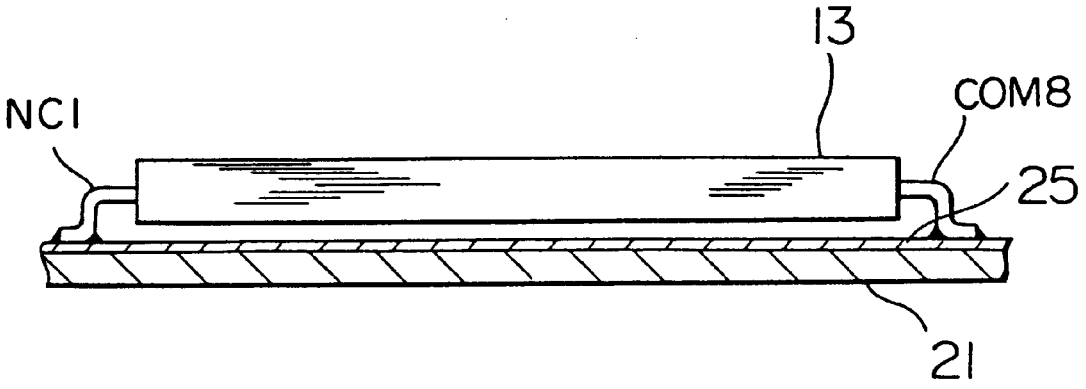
FIG. 8 is a sectional view of the third embodiment of this invention.
Figure 9:
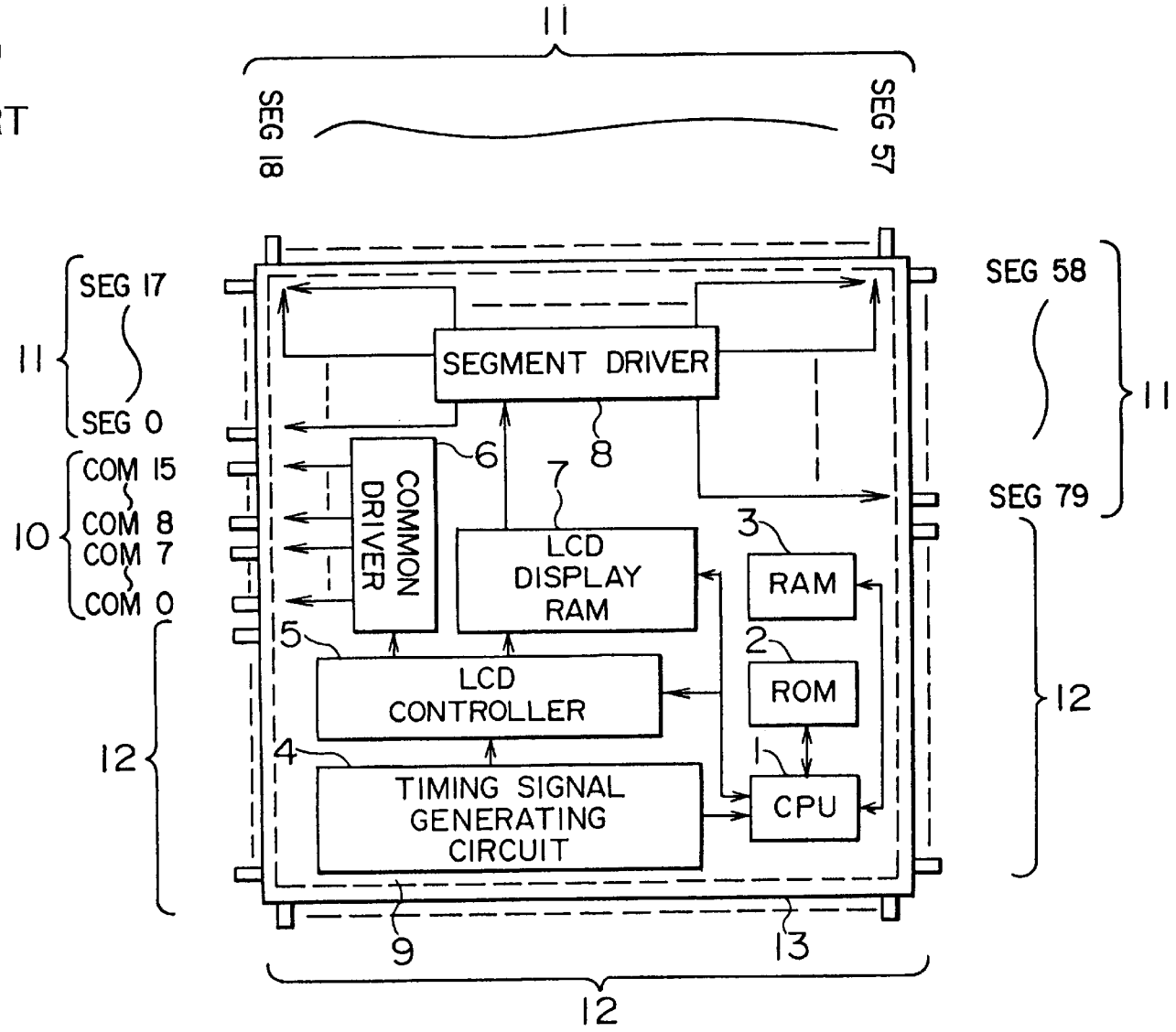
FIG. 9 PRIOR ART
FIG. 9 is a plan view showing a conventional microcomputer.
Figure 10:
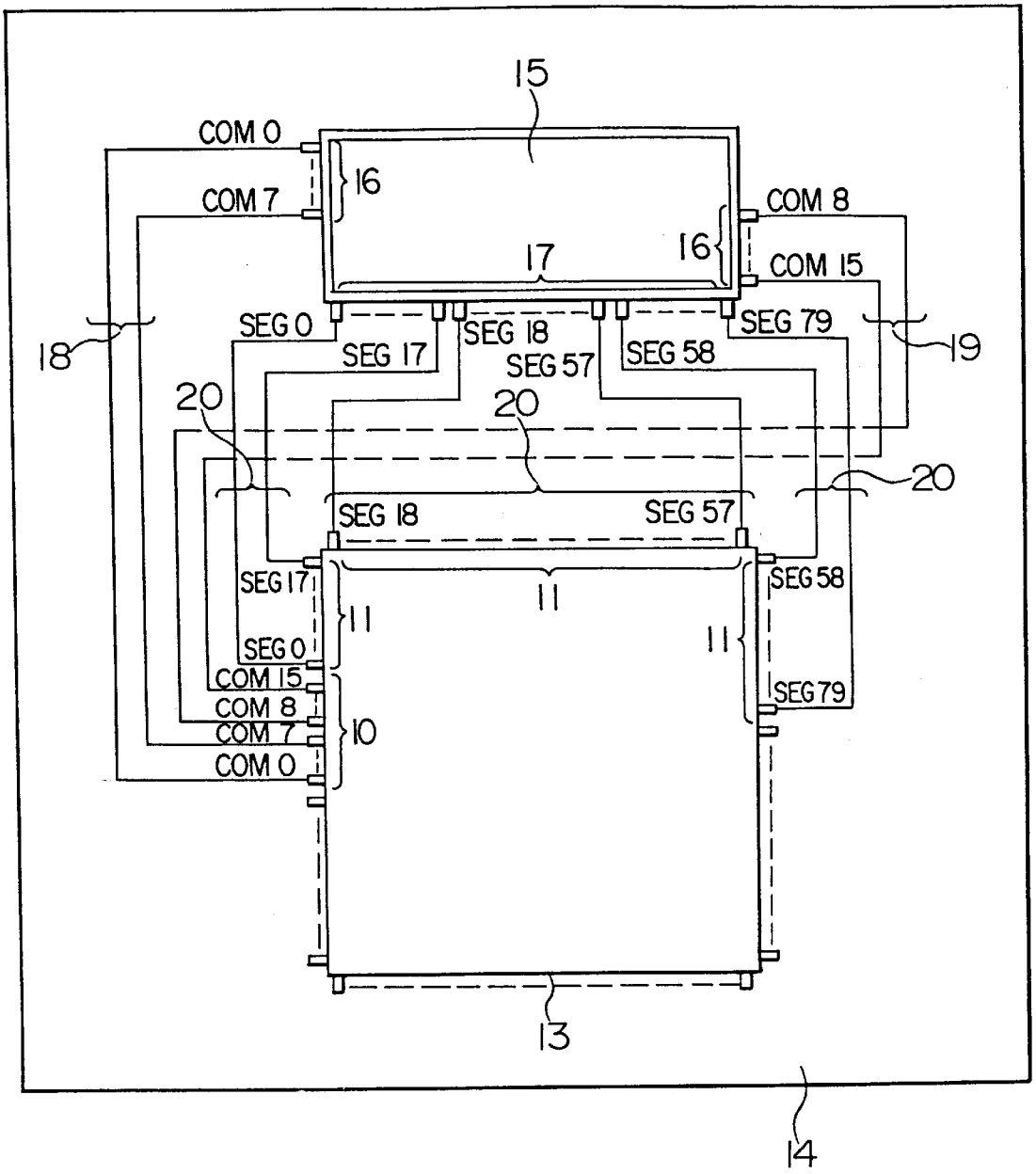
FIG. 10 PRIOR ART
FIG. 10 is a plan view showing a substrate on which a conventional microcomputer and a LCD panel are mounted.

FIG. 6 is a plan view of a semiconductor device according to the third embodiment of this invention. In the drawing, numeral 24 indicates newly provided terminals of a fourth outlet-terminal group. They are non-connection terminals (NC 1 to 3) which are opposed to one side of the semiconductor chip 9 and are arranged adjacent to SEG 0 at one outermost end of the segment terminals SEG 0 to 25, continuously at intervals, for example, of 0.50 mm, without being electrically connected to the semiconductor chip 9. FIG. 7 is a plan view showing a single-layer printed circuit board 21 on which are mounted an LCD panel 15 having scanning electrodes on one side thereof and a microcomputer (semiconductor device) as shown in FIG. 6. In the drawing, numeral 25 indicates a printed wiring group, as shown in the sectional view of FIG. 8, on the surface of the single-layer printed circuit board 21 opposed to the reverse side of the flat package 13 of the microcomputer which connects COM 8 to COM 10 of the common terminals 10 to NC 1 to NC 3 of the non-connection terminals 24. Numeral 26 indicates a printed wiring group on the surface of the single-layer printed circuit board 21 and which connects NC 1 to NC 3 of the non-connection terminals 24 to COM 8 to COM 10 of the scanning electrodes 16. Like the printed wiring groups 25 and 26, the printed wiring groups 18 and 20 are on the surface of the single-layer printed circuit board 21.

Thus, NC1 to NC3 of the non-connection terminals 24 are electrically connected to COM 8 to COM 10 of the common terminals 10 through the printed wiring group 25 on the circuit board 21 opposed to the reverse side of the flat package 13, and function equivalent to COM 8 to COM 10 of the common terminals 10. In the connection shown in FIG. 7, however, the printed wiring groups 18, 20, 25 and 26 do not cross each other even with a LCD panel having more scanning electrodes on one side than the common terminals, so that connection in one plane is possible, thus allowing connection using a single-layer printed circuit board 21. Accordingly, the same effect as that of the above embodiment is obtained.

ADVANTAGES OF THE INVENTION

As described above, in accordance with this invention, a semiconductor device comprises: a semiconductor chip including segment signal outputting means having a plurality of output nodes for outputting segment signals for a display device controlled and selected by segment signals and scanning signals 2 and scanning signal outputting means having a plurality of output nodes for outputting scanning signals for the display device; a first outlet-terminal group including a plurality of segment-signal outlet terminals arranged continuosly at first and second, opposite sides of the semiconductor chip at predetermined intervals and respectively electrically connected to corresponding output nodes of the segment signal outputting means; a second outlet-terminal group including a plurality of scanning-signal outlet terminals opposed to the first side of the semiconductor chip and arranged adjacent to the segment-signal outlet terminals at the first along this side of the semiconductor chip at predetermined intervals and respectively electrically connected to corresponding output nodes of the scanning signal outputting means; and a third outlet-terminal group including a plurality of scanning-signal outlet terminals opposed to the second side of the semiconductor chip and arranged adjacent to the segment-signal outlet terminals at the second side of the semiconductor chip at predetermined intervals and respectively electrically connected to corresponding output nodes of the scanning signal outputting means, whereby a semiconductor device with reduced substrate cost and facilitated substrate design is obtained.

As described above, in accordance with the second embodiment of this invention, there are formed: a semiconductor chip including segment signal outputting means having a plurality of output nodes for outputting segment signals for a display device controlled and selected by segment signals and scanning signals, and scanning signal outputting means having a plurality of output nodes for outputting scanning signals for the display device; a first outlet-terminal group including a plurality of segment-signal outlet terminals arranged continuously at first and second, opposite sides of the semiconductor chip at predetermined intervals and respectively electrically connected to corresponding output nodes of the segment signal outputting means; a second outlet-terminal group including a plurality of scanning-signal outlet terminals opposed to the first side of the semiconductor chip and arranged adjacent to the segment-signal outlet terminals at the first, side of the semiconductor chip at predetermined intervals; a third outlet-terminal group including a plurality of scanning-signal outlet terminals opposed to the second side of the semiconductor chip and arranged adjacent to the segment-signal outlet terminals at the second side of the semiconductor chip at predetermined intervals; and selection means on the semiconductor chip for selectively outputting scanning signals from the scanning signal outputting means to the plurality of scanning-signal outlet terminals of one of the second and third outlet-terminal groups, whereby a semiconductor device with reduced substrate cost and facilitated substrate design is obtained.

As described above, in accordance with the third embodiment of this invention, a semiconductor device comprises: a semiconductor chip including segment signal outputting means having a plurality of output nodes for outputting segment signals for a display device controlled and selected by segment signals and scanning signals, and scanning signal outputting means having a plurality of output nodes for outputting scanning signals for the display device; a first outlet-terminal group including a plurality of segment-signal outlet terminals arranged continuously at first and second, opposite sides of the semiconductor chip at predetermined intervals and respectively electrically connected to corresponding output nodes of the segment signal outputting means; a second outlet-terminal group including a plurality of scanning-signal outlet terminals opposed to the first side of the semiconductor chip and arranged adjacent to the segment-signal outlet terminal at the first side of the semiconductor chip at predetermined intervals and respectively electrically connected to corresponding output nodes of the scanning signal outputting means; a third outlet-terminal group including of a plurality of scanning-signal outlet terminals opposed to the second side of the semiconductor chip and arranged adjacent to the segment-signal outlet terminals at the side of the semiconductor chip at predetermined intervals and respectively electrically connected to corresponding output nodes of the scanning signal outputting means; and a fourth outlet-terminal group including a plurality of scanning-signal outlet terminals opposed to the first side of the semiconductor chip and arranged adjacent to the second outlet-terminal group and having at least one outlet terminal for electrical connection to the scanning-signal signal outlet terminals of the third outlet-terminal group, whereby a semiconductor device with reduced substrate cost and facilitated substrate design is obtained.

What is claimed is:

1. A semiconductor device comprising:

a semiconductor chip including segment signal outputting means having a plurality of output nodes for outputting segment signals for a display device controlled and selected by segment signals and scanning signals, and scanning signal outputting means having a plurality of output nodes for outputting scanning signals for the display device;

a first outlet-terminal group including a plurality of segment-signal outlet terminals arranged continuously at first and second, opposite sides of the semiconductor chip at predetermined intervals and respectively electrically connected to corresponding output nodes of the segment signal outputting means;

a second outlet-terminal group including a plurality of scanning-signal outlet terminals disposed along the first side of the semiconductor chip and arranged adjacent to the segment-signal outlet terminals at the first side of the semiconductor chip at predetermined intervals and respectively electrically connected to corresponding output nodes of the scanning signal outputting means; and a third outlet-terminal group including a plurality of scanning-signal outlet terminals disposed along the second side of the semiconductor chip and arranged adjacent to the segment-signal outlet terminals at the second side of the semiconductor chip at predetermined intervals and respectively electrically connected to corresponding output nodes of the scanning signal outputting means.

2. The semiconductor device according to claim 1 comprising selection means on the semiconductor chip for selectively outputting scanning signals from the scanning signal outputting means to the plurality of scanning-signal outlet terminals of one of the second and third outlet-terminal groups.

3. The semiconductor device according to claim 1 comprising a fourth outlet terminal group along the first side of the semiconductor chip, arranged adjacent to the second outlet-terminal group and having at least one outlet terminal for electrical connection to the scanning-signal outlet terminals of the third outlet-terminal group.

* * * * *